US006444093B1

(12) United States Patent
Luomi et al.

(10) Patent No.: US 6,444,093 B1
(45) Date of Patent: Sep. 3, 2002

(54) METHOD IN A TREATMENT PROCESS OF A PAPER WEB AND TREATMENT DEVICE FOR A PAPER WEB

(75) Inventors: Seppo Luomi, Järvenpää; Petteri Lannes, Jokela, both of (FI)

(73) Assignee: Mepso Paper, Inc., Helsinki (FI)

( * ) Notice: Subject to any disclaimer, the term of this patent is extended or adjusted under 35 U.S.C. 154(b) by 0 days.

(21) Appl. No.: 09/529,370

(22) PCT Filed: Aug. 16, 1999

(86) PCT No.: PCT/FI99/00678

§ 371 (c)(1),
(2), (4) Date: Apr. 14, 2000

(87) PCT Pub. No.: WO00/09432

PCT Pub. Date: Feb. 24, 2000

(30) Foreign Application Priority Data

Aug. 14, 1998 (FI) ..... 981758

(51) Int. Cl.[7] ..... D21F 11/00

(52) U.S. Cl. ..... 162/202; 162/204; 242/66; 242/541.4; 242/544.1; 242/75.5; 100/38; 100/93; 100/162 B; 100/163 A; 310/90.5

(58) Field of Search ..... 162/204, 202; 242/66, 541.4, 75.5, 544.1; 100/38, 93, 162 B, 163 A; 310/90.5

(56) References Cited

U.S. PATENT DOCUMENTS

| | | | | |
|---|---|---|---|---|
| 3,834,642 A | | 9/1974 | Kampf | 242/75.5 |
| 4,811,915 A | | 3/1989 | Smith | 242/66 |
| 4,817,883 A | | 4/1989 | Hoffmann et al. | 242/66 |
| 5,438,920 A | | 8/1995 | Koivukunnas et al. | 100/38 |
| 5,611,500 A | | 3/1997 | Smith | 242/541.4 |
| 5,682,071 A | * | 10/1997 | Buhler et al. | 310/90.5 |

FOREIGN PATENT DOCUMENTS

| | | | |
|---|---|---|---|
| EP | 0517830 | 1/1994 | G01N/3/40 |
| WO | 9113337 | 9/1991 | G01N/3/40 |
| WO | 9722543 | 6/1997 | B65H/18/26 |

* cited by examiner

*Primary Examiner*—Stanley S. Silverman
*Assistant Examiner*—Mark Halpern
(74) *Attorney, Agent, or Firm*—Steinberg & Raskin, P.C.

(57) ABSTRACT

In the treatment process of a paper web, the paper web travels via a surface journalled rotatable, such as a peripheral surface of a cylinder or a roll, and the treatment process is controlled with an adjustment and control unit. The bearing arrangement used for the moving surface is a bearing whose operation is maintained by supplying control energy therein, wherein the information obtained from the control energy of the bearing is used in the adjustment and control unit to control the process. The bearing which is used can be a magnetic bearing and the process which is controlled can be reeling or winding or calendaring.

26 Claims, 4 Drawing Sheets

METHOD IN A TREATMENT PROCESS OF A PAPER WEB AND TREATMENT DEVICE FOR A PAPER WEB

FIELD OF THE INVENTION

The present invention relates to a method in a treatment process of a paper web wherein in the treatment process, the paper web travels via a surface journaled rotatable, such as the peripheral surface of a cylinder or roll and the treatment process is controlled with an adjustment and control unit. The present invention also relates to a treatment device for carrying out this method.

BACKGROUND OF THE INVENTION

In particular, the invention relates to such a treatment processes in which a web travels a long distance via a surface journalled rotatable or only in a short nip contact thereto, and the web is subjected to a force affecting the web in the form of a nip pressure and/or tension. An example of the treatment process of the paper web is the reeling process of a continuous reel-up. In the reeling process, a continuous web of several meters in width, passed from the previous sections of a paper machine or finishing apparatus for paper, is reeled around a reel core (reel spool). The web is passed onto the reel via a reeling cylinder, wherein a particular linear pressure prevails in the reeling nip between the reeling cylinder and the reel (the point where the web is passed on the reel guided by the reeling cylinder), the linear pressure being produced with suitable loading arrangements, by means of which a particular loading force is attained between the reeling cylinder and the reel. This is typically implemented by loading the reel with force devices connected to the ends of the reel core on both edges of the reel.

The control of the loading is crucial in the reeling process, because the used loading affects the quality of the reel and its behaviour in the further processing. It should be possible to accurately measure the linear pressure effective in the reeling nip, and the actuators affecting the linear pressure should be controlled by means of the same. The control and management of the linear pressure or "nip force" is, however, difficult primarily because of the point of action of the force to be measured (the contact point between the reeling cylinder rotating at high peripheral speed and the reel). The reeling can also be effected at different angles with respect to the reeling cylinder, i.e. the location of the nip on the periphery of the reeling cylinder can vary, especially during so-called initial reeling. This complicates the act of calculating the linear pressure solely on the basis of the loading by the force device, because the mass of the reel, which is constantly growing, as well as the location of the reel, affect the linear pressure.

Heretofore, force sensors have been used in the structures of the reel-up to measure the linear pressure, and as examples of these principles, it is possible to mention the publications WO 97/22543, U.S. Pat. No. 5,611,500 and EP 517830. By means of measurement signals given by the sensors, it is possible to adjust the reeling operation. In order to obtain sufficient information on the actual linear pressure, i.e, nip force at different stages of the reeling, sensors have to be placed in several different locations. Several separate components cause interference factors, and their properties change in different ways during time, wherein it is difficult to control the changes. Similarly, it has been observed in practice that the force sensors are liable to break in a paper machine environment. The force sensors also have to be dimensioned to oversize because of possible high force peaks which are always produced during the reeling. Part of the sensors have to be placed in movable parts, wherein lines are necessary for conducting signals therefrom to the control system. Since the measurement in question is an indirect measurement, different friction factors cannot be eliminated.

Another treatment process for the paper web in which an accurate control of the linear pressure has to be attained, is calendering. The calendering process is disclosed e.g. in the Finnish patent 96334 and in the corresponding U.S. Pat. No. 5,438,920.

OBJECTS AND SUMMARY OF THE INVENTION

The purpose of the invention is to present a solution for the aforementioned problems and a new method in the reeling process of a paper web, as well as a reel-up for a paper web, by means of which the linear pressure can be controlled more accurately. To attain this purpose, the method according to the invention is primarily characterized in what will be presented in the characterizing part of the appended claim 1. The device according to the invention, in turn, is characterized in what will be presented in the characterizing part of the appended claim 11.

The invention is based on the idea that the bearing arrangement used for the moving surface which guides the web and with which, for example in the case of a reel-up, the reel to be formed from the web is in contact, is a bearing, which is of such a type that it requires external energy, control energy, to maintain its operation, i.e. the clearance of the bearing that enables rotation requires a certain power. The signal obtained from the control energy of the bearing is utilized in the control of the treatment process. In the reel-up and in the calender, the signal is used especially to control the linear pressure, i.e. the nip force.

The entire linear pressure, i.e. the nip force, acts on the moving surface in question, which typically is a cylinder or a roll journalled rotatable in the frame of a part of the machine. This force is also manifested in the function of the bearing which requires energy. Thus, the bearing can be used in the reel-up to determine all nip forces, irrespective of the position or the mass of the reel, i.e. both during the initial reeling, wherein the reel can be located more or less above the horizontal plane extending via the central axle of the reeling cylinder, as well as in the final reeling in the actual reeling station in which the reel grows into its full size. There is only one measurement point, or if the bearing arrangements of both sides are utilized, there are two measurement points at the most, and the interferences occurring therein can be more easily controlled.

In the calender, the bearing can be used in the bearing arrangement of one or more calender rolls, wherein the loading exerted on the roll can be measured and the calendering process, especially the loading devices determining the linear pressure affecting the paper passed through the calender nip, can be controlled by means of the same.

A third advantageous target of use is a roll guiding the paper web, over which roll the web travels with a particular tension. Thus, the tension causes a certain force to the roll in the radial direction, which force can be detected from the signal obtained from the control energy of the bearing arrangement of the roll. On the basis of this information it is possible to control the draw difference.

According to a preferred embodiment, it is possible to use a magnetic bearing. In the magnetic bearing it is possible to maintain the clearance by adjusting the electric current to be supplied to the bearing. The force acting upon the reeling cylinder, the calender roll or the roll for measuring tension also has effect on this need for electric current, and on the basis of this it is possible on the basis of the magnitude of the electric current supplied or the magnitude of a variable proportional thereto, to obtain information on the forces acting on the cylinder or the roll journalled by means of the magnetic bearing, such as the nip load acting on the reeling cylinder, the loading effected by the calender nip to the calender roll, or the force applied to the roll by the tension of the web guided by a guide roll.

By virtue of the invention, it is not necessary to estimate the effect of the frictions of different movable parts in the control. The measurement takes place with the minimum of one member (a bearing arrangement requiring control energy), which provides a result in which different friction factors have been eliminated.

BRIEF DESCRIPTION OF THE DRAWINGS

In the following, the invention will be described in more detail with reference to the appended drawings, in which.

DETAILED DESCRIPTION OF THE INVENTION

Figure 1:
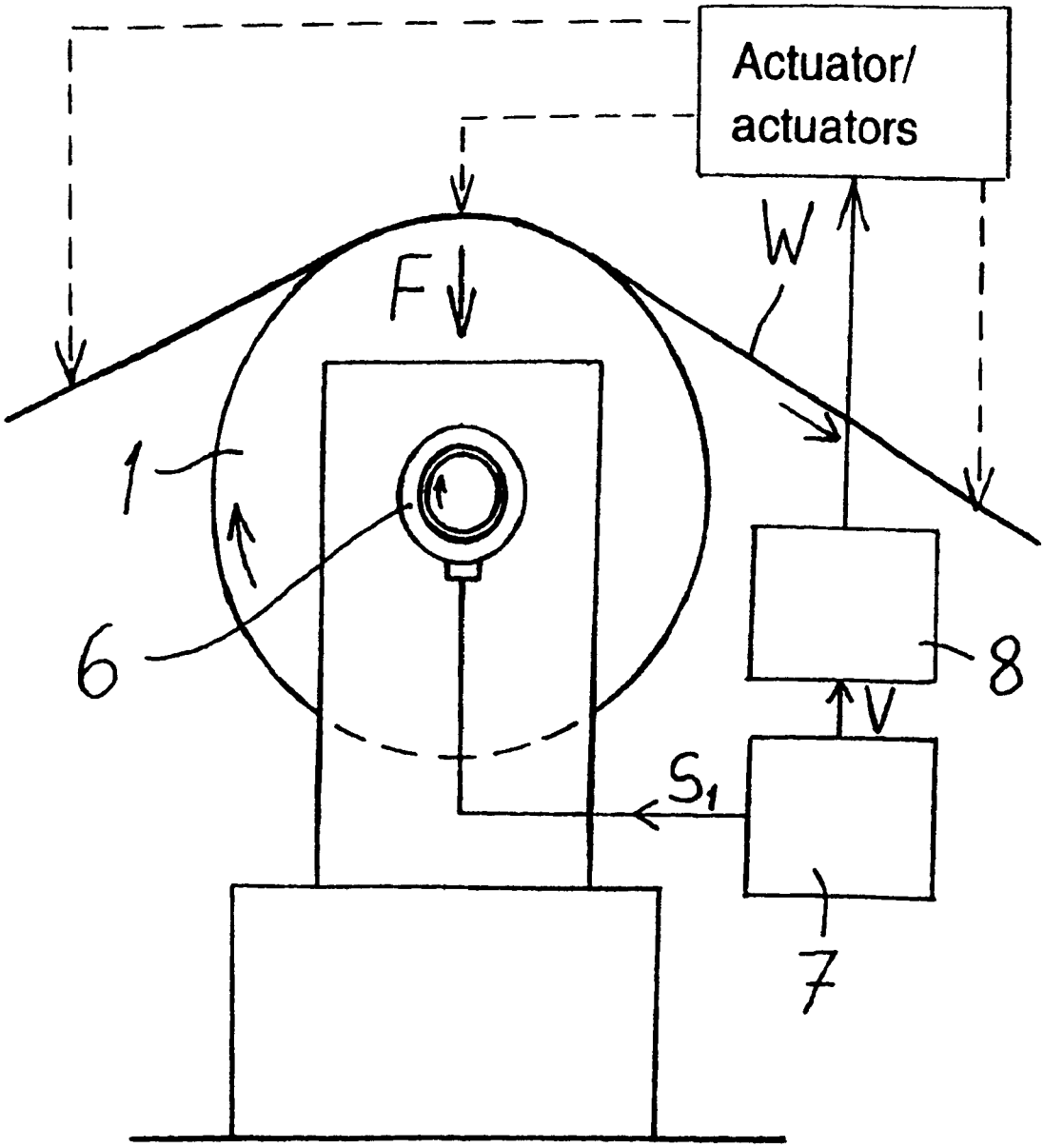
FIG. 1 shows a general principle of the invention in a side-view of a roll or a cylinder journalled rotatable.

FIG. 1 shows a general principle of the invention. A paper web W travels in a paper machine or finishing machine for paper and it is guided by a roll or a cylinder 1 journalled rotatable. The roll or the cylinder 1 is journalled to a support with a bearing 6 which requires control energy. The supply of energy is controlled with a control unit 7 by means of a control signal $S_1$. The rotating roll or cylinder 1 is subjected to a force F in the radial direction, which force is due to the treatment of the web and is transmitted to the bearing 6. From the control unit 7, a control signal V produced by means of the control signal $S_1$ is transmitted to a control unit 8 for the web treatment. The control signal is utilized as such or in a suitably transformed form for the control of such an actuator or an entity of actuators, which is capable of affecting the process in such a way that the force F is changed. Thus, it is possible to achieve a closed control loop by using the bearing 6 itself as a sensor and by taking the measurement information from such a variable, preferably an electric variable, which is already required as such for the actual function of the bearing.

Figure 2:
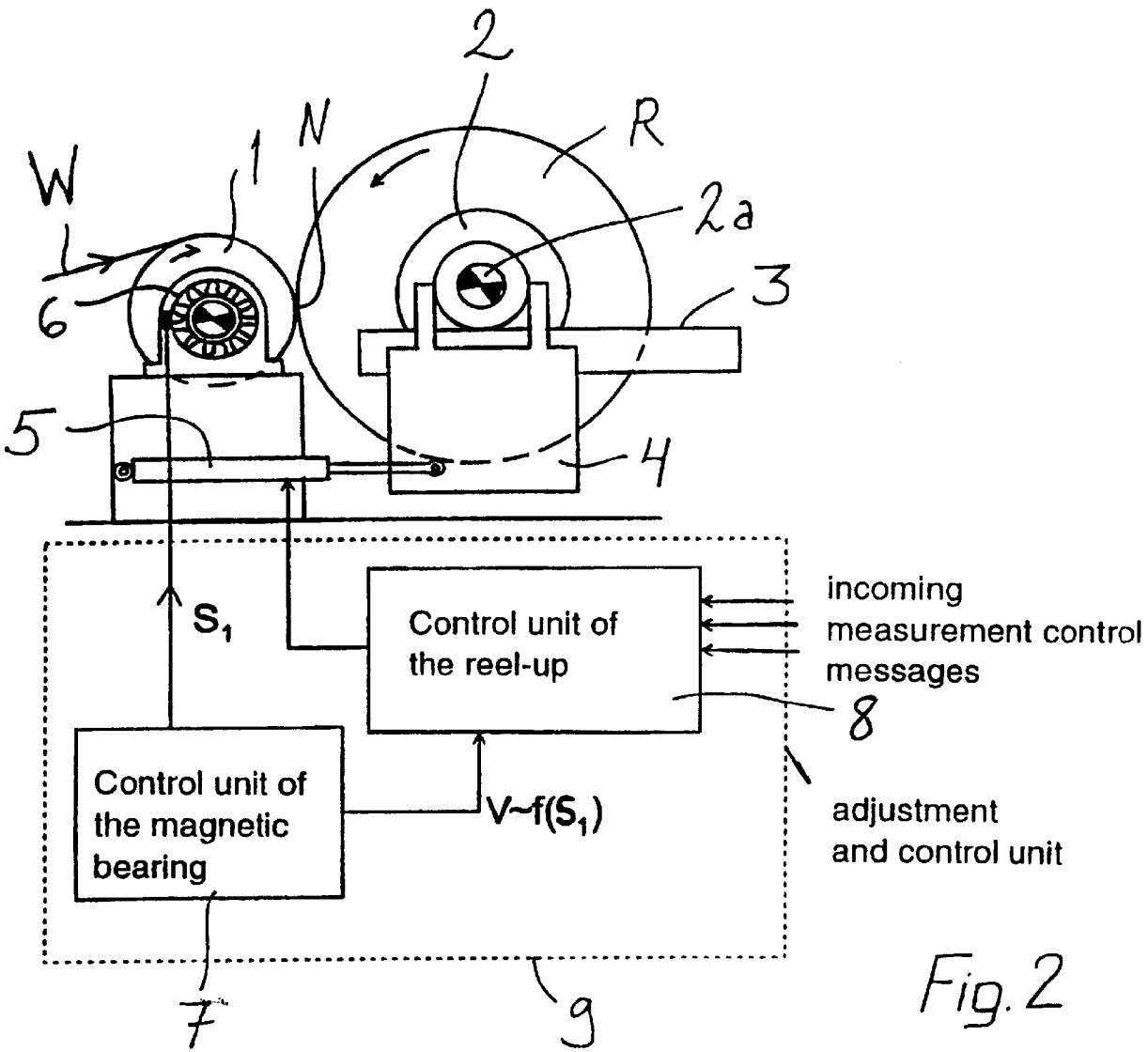
FIG. 2 shows the principle of the invention in a schematic diagram attached to a side-view of a reel-up.

FIG. 2 shows a reel-up for paper web in which a continuous paper web W, typically several meters in width, is passed from the preceding sections of a paper machine or a finishing apparatus for paper via a reeling cylinder 1 journalled rotatable in the frame of the reel-up. The paper web wraps in a particular sector the periphery of the reeling cylinder 1, whereafter it is transferred to a reel R, which is formed around a rotating reel core 2 i.e. a reel spool located in a support structure 3, e.g. on reeling rails. The reel R and the reeling cylinder 1 are in nip contact with each other through a reeling nip N, and the linear pressure i.e. the nip force effective in this reeling nip is adjusted with a loading mechanism, which in the situation of the drawing is composed of carriages 4 connected to the ends of the reel core 2, and a force device 5 which acts on the carriage and therethrough the end of the reel core 2. Both edges of the reel R are provided with a corresponding loading mechanism. The force effected by the force device 5 can be adjusted, and the force device is typically a hydraulic cylinder.

The reeling cylinder 1 is rotated with a drive motor. The reel R is also actively rotated with a centre-drive 2*a* of the reel spool 2.

The reeling cylinder 1 is journalled to the frame, in this case to a pedestal located in the frame of the reel-up, by means of a magnetic bearing arrangement 6. The magnetic bearing is a bearing type known as such, and it is not necessary to discuss its construction in more detail in this context. As for the operating principle and control of the bearing, reference is made for example to the U.S. Pat. No. 5,682,071.

It is typical for the magnetic bearing that its rotating part (rotor) levitates by the effect of the magnetic force of electromagnets, and it has to be constantly supplied with energy in order to maintain the operation of the bearing. The supply of energy is controlled with a control unit 7 of the magnetic bearing by means of a control signal $S_1$. This signal gives the amount of energy supplied to the magnetic bearing, which amount is proportional to the magnitude of the forces exerted on the bearing. In this case the bearing is subjected to forces which are due to the weight of the reeling cylinder itself and the web tension of the web entering the reeling cylinder, as well as to a force which is due to the mutual loading of the reel R and the reeling cylinder 1. If the forces produced by the weight of the reeling cylinder 1 and the web tension together are presumed to be constant all the time, the force exerted on the bearing changes when the nip force i.e. the linear pressure is changed. The mass of the reeling cylinder is constant, and the web tension is often measured with a separate measuring device, which is located for example before the reeling cylinder, and consequently the portion of the web tension is known even in cases when it cannot be presumed constant.

The control signal $S_1$ is used as a measured variable, by means of which it is possible to control the force device 5 producing the loading. From the control unit 7 of the magnetic bearing a control signal $V \sim f(S_1)$ produced in a suitable way by means of the control signal $S_1$ of the magnetic bearing is transmitted to the control unit 8 of the reel-up, This control signal can be used as such to control the force device 5, or it can still be converted in the control unit 8 of the reel-up. It is also possible that all the calculations and transformations for converting the signal $S_1$ to the control signal of the force device 5 are conducted in the control unit 8 of the reel-up. In addition, it is also possible that other signals are transmitted to the control unit 8 of the reel-up from other measurement points of the reeling process, for example web tension information received from the aforementioned measuring device for the web tension, which web tension information is used to eliminate the effect of the web tension, and these signals are also used together with the signal received from the control unit of the magnetic bearing to control the force device 5.

The control unit 7 of the magnetic bearing and the control unit 8 of the reel-up can be integrated in one adjustment and control unit 9 for the nip force (force device 5), as illustrated with broken lines in FIG. 2.

By means of the invention it is possible to achieve a closed control loop in such a way that the control signal is assigned a set value, which corresponds to a particular loading situation, the control signal is used as a measured variable, and the loading is adjusted in such a way that the control signal, i.e. the control energy of the bearing arrangement, corresponds to the predetermined value. When the reeling proceeds, this set value can change in accordance with a particular timetable or depending on another variable changing during the reeling. The set value can change for example in accordance with the amount of paper reeled on the reel, the diameter of the paper reel, or the mass of the reel attained either by measurement or calculation.

Figure 3:
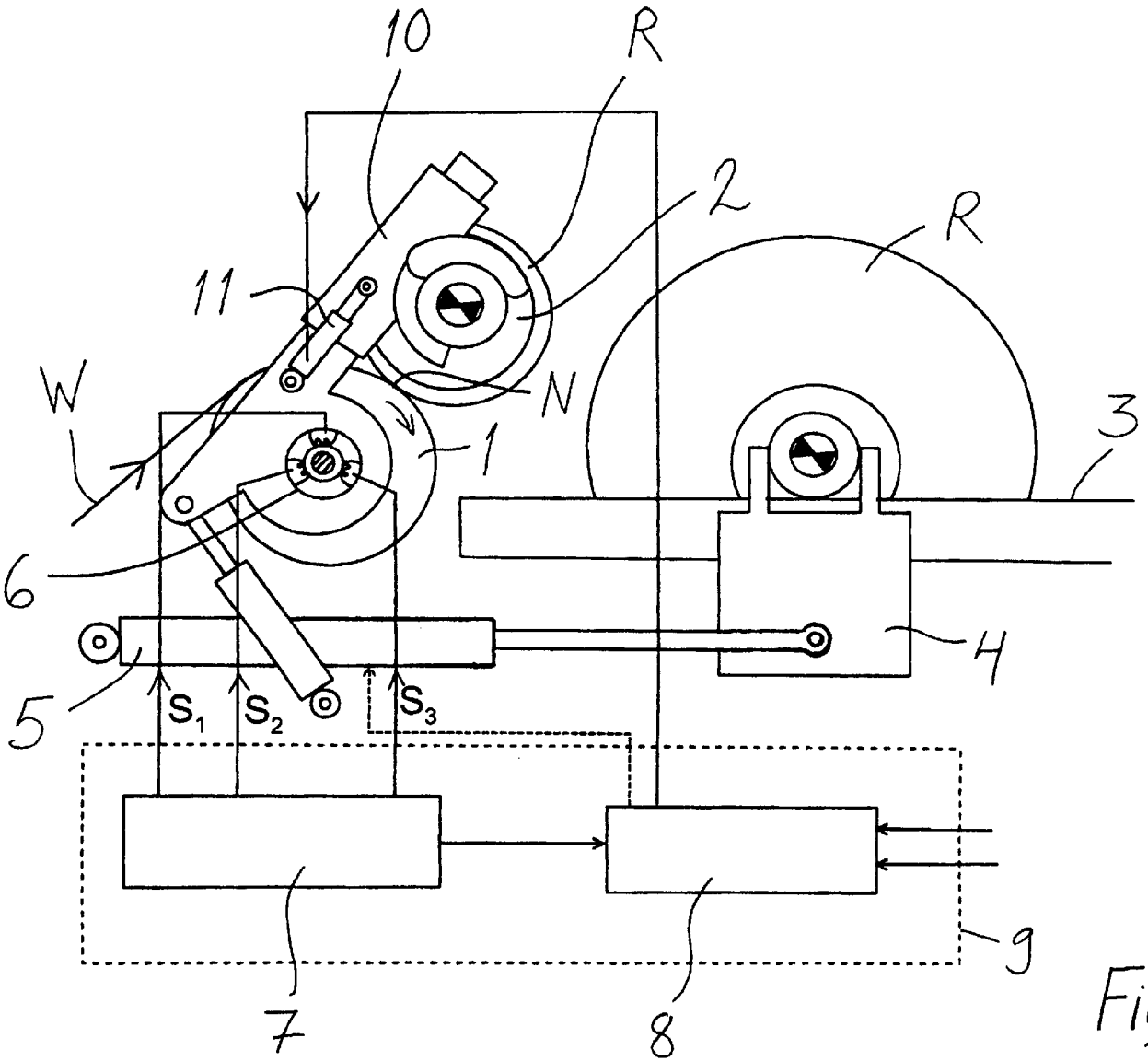
FIG. 3 illustrates the use of the invention at different stages of the reeling process.

FIG. 3 illustrates a reeling process implementing the principle of FIG. 1, and the functionally similar parts are described with the same reference numbers. The drawing shows a side-view of a reel-up in a situation where a full reel R has been transferred further away form the reeling cylinder 1 by means of reeling carriages 4, the web 1 has been cut, and its new end has been guided around a new, empty reel core 2 with change methods known as such. FIG. 2 illustrates the possibility to utilize the invention also for the control of initial reeling taking place in an initial reeling device 10, wherein a corresponding force device 11 of the initial reeling device is controlled according to the same principles as the force device 5 of FIG. 1. As can be seen in the situation of FIG. 2, in the initial reeling the reel core 2 and the reel R formed around the same and growing in the thickness direction, are clearly located above the horizontal plane extending through the central axis of the reeling cylinder 1, for example at the angular distance of over 15°, i.e. the corresponding reeling nip N is located at this point. During the initial reeling, the loading of the reeling nip N is influenced not only by the loading produced by the force device 11 but also by the radial component of the weight of the reel core and the constantly growing reel R. The linear pressure i.e. the nip force of the reeling nip N, which is the sum of the aforementioned factors, is again obtained as a whole by means of the energy required by the magnetic bearing.

FIG. 3 also shows a case in which there are several separate control/operating zones in the magnetic bearing arrangement 6, the amount of energy therein being controllable with several separate signals $S_1$–$S_N$, respectively. Thus information is obtained from different zones in the direction of the periphery of the magnetic bearing arrangement 6, and thus it is possible to separate the forces exerted on the periphery of the reeling cylinder 1 from different directions, for example the force effected by the tension of the web W and the nip force in the reeling nip N. According to FIG. 3, there are at least three different zones, wherein the corresponding signals $S_1$, $S_2$ and $S_3$ illustrate zone-specific signals each corresponding to the supply of energy to a zone of its own. By means of these signals more information can be obtained to determine the control signal of the force device 11. The control signal V is thus obtained as a function $f(S_1, S_2, S_3)$ of the signals of different zones. From the control unit 7 of the magnetic bearing, a control signal V which is produced in a suitable way by means of the control signals $S_1$, $S_2$, $S_3$ of different zones of the magnetic bearing, is transmitted to the control unit 8 of the reel-up. This control signal $V \sim f(S_1, S_2, S_3)$ can be used as such to control the force device 11, or it can still be converted in the control unit 8 of the reel-up. It is also possible that all calculations and transformations for converting the signals $S_1$, $S_2$, $S_3$ to the control signal of the force device are conducted in the control unit 8 of the reel-up. Furthermore, it is also possible that the control unit 8 of the reel-up receives other signals form other measurement points of the reeling process, and these signals are also used together with the signal received from the control unit of. the magnetic bearing to control the force device 11.

Even though FIG. 3 shows the use of differentiated signals for the control of loading in initial reeling, it can also be used at the final reeling stage in which a full reel is produced. Similarly, the principle of FIG. 2 in which only one signal is used can be utilized to control the initial reeling of FIG. 3. The principle is dependent on the magnetic bearing arrangement of the reeling cylinder 1 and the control of the same.

FIGS. 2 and 3 show only one magnetic bearing arrangement 6. It is, however, possible to use a magnetic bearing arrangement 6 on both sides of the reeling cylinder 1, i.e. on the tending side and on the drive side, wherein the control information of the bearing arrangement can be used only to control the force device/devices on the same side, wherein the loading on different sides of the reel-up can be controlled independently. The loading on different sides can also be adjusted separately in such a way that loading on the same side is controlled primarily on the basis of the signal received from the control energy of the corresponding bearing arrangement, wherein to obtain the actual control signal of the loading, the signal can be supplemented with other data, such as data received from the control energy of the opposite side. It is also possible to use the signals received from both sides to produce one common control signal which is used to control the force devices 5, 11 on both sides.

In the reel-up it is also possible to use a back-up system for possible failures in the energy supply of the magnetic bearing arrangements. A back-up bearing arrangement can be located coaxially with respect to the magnetic bearing arrangement on the same side of the reeling cylinder, and it should be provided with a sufficient clearance so that it does not influence the state of the magnetic bearing during normal operation, but is capable of receiving loads in case of an emergency.

By means of the supply of energy of the magnetic bearing it is possible to monitor the other functions of the reel-up as well. It is, for example, possible to detect different disturbances, such as vibration.

Hereinabove, the reeling cylinder refers to such cylinders or rolls arranged rotatable, which in contact with the reel R enable a particular linear pressure, i.e. nip force, in the reeling nip N. The drawings illustrate the way in which the reeling cylinder 1 is journalled rotatable in a stationary part of the frame of the reel-up. It is, however, possible that the reeling cylinder is journalled in a moving part which can be moved for example in accordance with the growth of the reel R. The function of the invention can thus be exactly the same as the one described above, the only difference being that the magnetic bearing arrangement 6 is located in a moving construction.

The above-presented reel-up of a full-width web constantly reels machine reels in the terminal end of a paper machine or an finishing machine for paper. The invention can also be used in reeling effected by means of a slitter-winder, in which the machine reel is wound to narrower reels, so-called customer rolls. A rotating roll which can be journalled with a magnetic bearing arrangement, is in these winders a rider roll loading the roll, or a carrier drum supporting the roll. In connection with the bearing arrangement of these rolls or drums it is possible to use the same measurement or adjustment principles as presented above.

Figure 4:
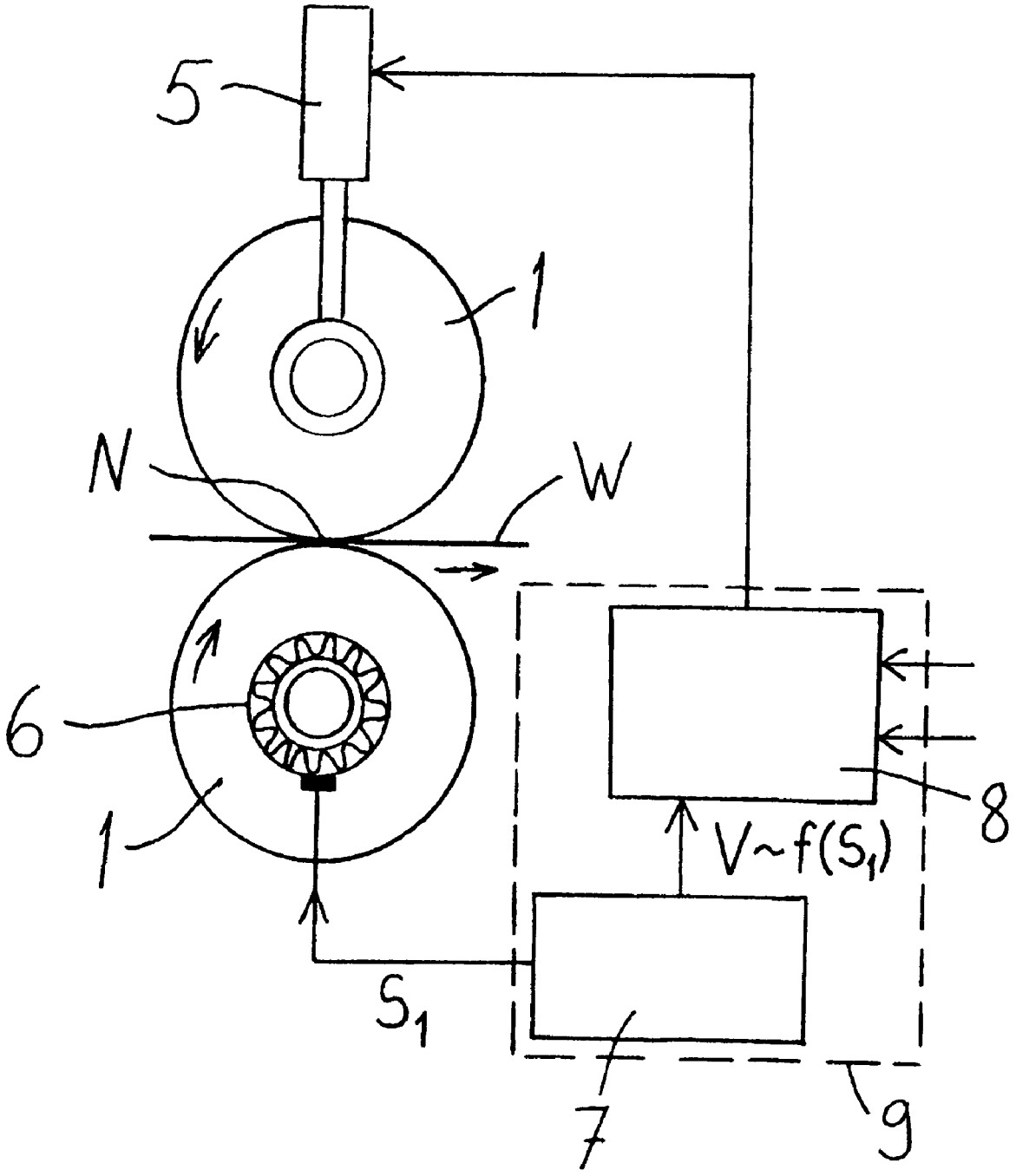
FIG. 4 illustrates the use of the invention in a calendering process.

FIG. 4 illustrates the act of applying the invention in a calender equipped with at least two rolls 1 which form a calender nip N therebetween, in which a particular linear load is exerted on the paper web W passed through the nip.

Of the rolls forming the nip, one calender roll 1 is journalled rotatable with a magnetic bearing arrangement 6. The linear pressure in the nip N can be adjusted from the control signal $S_1$ used for the supply of energy of the magnetic bearing, and by means of this it is possible to control the force device 5 affecting the linear pressure, in this case a force device 5 affecting the opposite calender roll, which force device 5 can be e.g. a hydraulic cylinder. The principle of the closed control system is the same as the one presented in connection with the reel-up, and the parts which are analogous with FIGS. 2 and 3 are marked with the same reference numbers. The calender roll 1 can be journalled on both sides with a magnetic bearing 6. Thus, the force devices on both sides can be controlled separately by means of the control energy information of the bearing 6 on the corresponding side, or the loading of the calender can be controlled by means of the information from both sides. The magnetic bearing 6 of the calender roll 1 may also be equipped with a back-up bearing arrangement with a clearance. The magnetic bearing arrangement 6 of the calender roll 1 can also be divided in zones to be supplied separately, as presented above. The magnetic bearing arrangement can be used in different calender types, for example in a stack of calender rolls of a multi-nip calender, to mount one or more calender rolls on bearings.

The bearing arrangement according to the invention can also be used to measure and adjust the tension of the web, wherein the device can be similar to that shown in FIG. 1. This differs from the embodiments of FIGS. 2 to 4 in that there is no nip against the roll or cylinder journalled with the bearing 6, but the mere web acts on the roll or the cylinder when it travels over it in a particular sector.

The invention can also be used in connection with other rolls or cylinders journalled rotatable in a paper machine or an after-treatment machine for paper, which guide the web or are in contact thereto.

Hereinabove, the invention has been described by referring primarily to a magnetic bearing. In the invention, it is also possible to apply other bearings which require power in order to maintain a rotation clearance. The clearance can be maintained for example with the pressure of a pressurized medium (gaseous or liquid, for example hydraulic oil), wherein the information obtained from the control energy can be the used pressure or the like. The adjustment can be implemented analogously with the facts presented in connection with magnetic bearings. The pressurized medium can also be used zonewise, wherein the utilization of zones in the control can also be implemented analogously with the facts presented above.

In this context, the term paper web refers to all reelable, continuous, paper-like webs made of fibrous raw material, irrespective of the grammage.

What is claimed is:

1. Method in a treatment process of a paper web wherein in the treatment process the paper web (W) travels over a moving surface journalled rotatable by means of a bearing arrangement and the treatment process is controlled with an adjustment and control unit (9), wherein the bearing arrangement used for the moving surface is a bearing (6) whose operation is maintained by supplying control energy therein, information is obtained from the control energy supplied, and the information obtained from the control energy of the bearing is used in the adjustment and control unit (9) to control the treatment process.

2. Method according to claim 1, wherein the information is used to adjust a variable which acts on the bearing (6) through the surface journalled rotatable.

3. Method according to claim 1, wherein the bearing arrangement used is a magnetic bearing (6) from whose control energy information is obtained which is used in the adjustment and control unit (9) to control the treatment process.

4. Method according to claim 1, wherein the bearing comprises different zones and the information used for the control is the information obtained from the control energy of the different zones of the bearing (6).

5. Method according to claim 1, wherein the adjustment and control unit (9) comprises a control unit (7) for the bearing arrangement and a control unit (8) for the process, a signal $V-f(S_n)$ being effective therebetween in which $S_n$ is the signal dependent on the control energy of the bearing (6) and n=1. . . m, wherein m=the number of different portions of control energy.

6. Method according to claim 1, wherein the moving surface is rotated by means of at least two separate bearings (6) which require control energy to maintain operation.

7. Method according to claim 6, wherein a tending side and a drive side of a machine conveying the paper web each comprise a bearing whose operation is maintained by supplying control energy therein and the tending side and the drive side are controlled separately substantially on the basis of information of the bearings (6) of the tending side and the drive side.

8. Method according to claim 1, wherein the treatment process is a reeling process of a paper web, in which the paper web is reeled continuously around a rotating reel core (2), a nip contact to the paper reel (R) to be formed on the reel core (2) is maintained by means of the moving surface, journalled rotatable by means of the bearing (6), and by means of the information obtained from the control energy of the bearing (6), the reeling process is controlled in the adjustment and control unit (9) of the reeling process.

9. Method according to claim 1, wherein the treatment process is a calendering process of the paper web (W) in which paper web is calendered by means of a calender nip formed by at least two moving surfaces, wherein at least one of the moving surfaces is journalled rotatable by means of the bearing (6) supplied with control energy, and by means of the information obtained from the control energy of the bearing (6) the calendering process is controlled in the adjustment and control unit (9) of the calendering process.

10. Method according to claim 1, wherein the treatment process consists of guiding the paper web (W) over a surface of a roll (1), wherein said roll is journalled rotatable by means of the bearing (6) supplied with control energy.

11. Treatment device for a paper web, which comprises a moving surface journalled rotatable by means of a bearing arrangement, the surface being arranged to guide a paper web (W) or to be in contact with the paper web, as well as an adjustment and control unit (9) for controlling the treatment device, wherein the moving surface is journalled rotatable with a bearing (6) which requires control energy to be supplied therein to maintain its operation and is connected to a supply of control energy, wherein the supply of control energy to the bearing is in a data transmission connection with the adjustment and control unit (9), and the adjustment and control unit (9) comprises means for controlling the treatment process on the basis of information received from the supply control energy.

12. Treatment device according to claim 11, wherein the bearing is a magnetic bearing (6) from whose control energy information is obtained to be used in the adjustment and control unit (9) to control the treatment device.

13. Treatment device according to claim 1, wherein the bearing (6) is provided with different zones, in which the supply of control energy is in a data transmission connection with the adjustment and control unit (9) of the treatment device, and the adjustment and control unit (9) comprises means for controlling the treatment device on the basis of the information obtained from the supply of different zones.

14. Treatment device according to claim 11, wherein the adjustment and control unit (9) comprises a control unit (7) for the bearing arrangement and a control unit (8) for the treatment device, connected with a data transmission line, and the control unit (7) of the bearing arrangement is arranged to produce a signal $V-f(S_n)$ in which $S_n$ is a signal dependent on the control energy of the bearing, and n=1. . . m, wherein m=the number of different portions of control energy.

15. Treatment device according to claim 11, wherein the moving surface is journalled rotatable by means of at least two separate bearings (6) which require control energy to maintain their operation, wherein the first such bearing is located on a tending side of a machine conveying the paper web, and the second such bearing is on a drive side of the machine, and the supply of control energy to both bearings is in a data transmission connection with the adjustment and control unit (9) of the treatment device.

16. Treatment device according to claim 11, wherein it comprises a force device capable of applying a force to affect a linear pressure in a nip contact of the moving surface with the web and on the basis of the information received from the supply of control energy of the bearing (6) the adjustment and control unit (9) is arranged to adjust the force of that force device (5, 11) which affects the linear pressure prevailing in the nip contact of the moving surface with the web (W).

17. Treatment device according to claim 11, wherein in addition to the bearing (6) requiring control energy to maintain operation, the moving surface is also journalled with a back-up bearing arrangement having a clearance.

18. Treatment device according to claim 11, wherein it is a reel-up or winder which is arranged to reel or wind the paper web (W) around a rotating reel core (2)

wherein a moving surface arranged rotatable by means of the bearing (6) supplied with control energy is arranged in a nip contact with the reel (R) formed from the paper web around the reel core (2) and the adjustment and control unit (9) comprises means for controlling the nip contact in the reeling or winding process.

19. Treatment device according to claim 11, wherein it is a calender with at least two moving surfaces which forma calendar nip therebetween, through which nip the web is arranged to travel, wherein at least one of the moving surfaces is journalled rotatable by means of the bearing (6) supplied with control energy.

20. Treatment device according to claim 11, wherein the moving surface journalled rotatable by means of the bearing (6) is a roll (1) guiding the web to define a travel of the web in a section running over the roll and the adjustment and control unit (9) comprises means for controlling the travel of the web in the section running over the roll (1).

21. Method according to claim 1, wherein the moving surface journalled rotatable by means of the bearing arrangement is a peripheral surface of a cylinder or a roll.

22. Method according to claim 4, wherein the bearing is a magnetic bearing comprising different zones and the information used for the control is the information obtained from the control energy of the different zones of the magnetic bearing.

23. Method according to claim 8, wherein the nip contact is controlled in the adjustment and control unit of the reeling process.

24. Method according to claim 9, wherein the calendering nip is controlled in the adjustment and control unit of the calendering process.

25. Treatment device according to claim 11, wherein the moving surface journalled rotatable by means of the bearing arrangement is a peripheral surface of a cylinder or a roll.

26. Treatment device according to claim 20, wherein the roll guiding the web is a tension measuring roll.

* * * * *

UNITED STATES PATENT AND TRADEMARK OFFICE

CERTIFICATE OF CORRECTION

PATENT NO. : 6,444,093 B1
DATED : September 3, 2002
INVENTOR(S) : Luomi et al.

It is certified that error appears in the above-identified patent and that said Letters Patent is hereby corrected as shown below:

Title page,
Item [73], Assignee, should read -- Metso Paper, Inc. --

Signed and Sealed this

Twenty-third Day of December, 2003

JAMES E. ROGAN
*Director of the United States Patent and Trademark Office*